US009199387B2

(12) United States Patent
Cummings et al.

(10) Patent No.: US 9,199,387 B2
(45) Date of Patent: Dec. 1, 2015

(54) METHOD AND APPARATUS FOR A RULES BASED UTILIZATION OF A MINIMUM-SLIT-HEAD CONFIGURATION PLUNGE SLITTER

(75) Inventors: James A. Cummings, Phillips, WI (US); John J. Kondratuk, Kennan, WI (US); Ronald H. Schmidt, Phillips, WI (US)

(73) Assignee: Marquip, LLC, Phillips, WI (US)

( * ) Notice: Subject to any disclaimer, the term of this patent is extended or adjusted under 35 U.S.C. 154(b) by 683 days.

(21) Appl. No.: 13/585,593

(22) Filed: Aug. 14, 2012

(65) Prior Publication Data

US 2013/0217557 A1 Aug. 22, 2013

Related U.S. Application Data

(62) Division of application No. 12/579,868, filed on Oct. 15, 2009, now Pat. No. 8,267,847.

(60) Provisional application No. 61/105,456, filed on Oct. 15, 2008.

(51) Int. Cl.

| | |
|---|---|
| ***B26D 5/02*** | (2006.01) |
| ***B26D 5/00*** | (2006.01) |
| ***B26D 7/26*** | (2006.01) |
| ***B26D 9/00*** | (2006.01) |
| ***B26D 11/00*** | (2006.01) |
| ***B31F 1/28*** | (2006.01) |
| *B26D 1/22* | (2006.01) |
| *B26D 1/24* | (2006.01) |
| *B26D 7/18* | (2006.01) |
| *B26D 7/00* | (2006.01) |

(52) U.S. Cl.

CPC .. *B26D 5/02* (2013.01); *B26D 5/00* (2013.01); *B26D 7/2635* (2013.01); *B26D 9/00* (2013.01); *B26D 11/00* (2013.01); *B31F 1/2822* (2013.01); *B26D 1/225* (2013.01); *B26D 1/245* (2013.01); *B26D 7/1863* (2013.01); *B26D 2007/0068* (2013.01); *Y10T 83/7826* (2015.04)

(58) Field of Classification Search

CPC ..... B26D 5/02; B26D 7/2635; B26D 1/225; B26D 1/245; B26D 7/1863; B31B 1/25; B31B 2201/255; B31F 1/10

See application file for complete search history.

(56) References Cited

U.S. PATENT DOCUMENTS

| | | | | |
|---|---|---|---|---|
| 3,646,418 | A * | 2/1972 | Sterns et al. | 318/603 |
| 3,786,705 | A * | 1/1974 | Dorfel | 83/76.7 |
| 3,961,547 | A * | 6/1976 | Shainberg et al. | 83/864 |
| 4,095,511 | A | 6/1978 | Woolston | |
| 4,269,097 | A | 5/1981 | Linn | |
| 4,506,577 | A | 3/1985 | Shinomiya et al. | |
| 5,125,301 | A | 6/1992 | Miller et al. | |
| 5,690,601 | A | 11/1997 | Cummings et al. | |
| 5,761,980 | A | 6/1998 | Ima et al. | |
| 5,857,395 | A * | 1/1999 | Bohm et al. | 83/408 |
| 6,103,171 | A | 8/2000 | Cummings | |

(Continued)

*Primary Examiner* — Sameh Tawfik

(74) *Attorney, Agent, or Firm* — Andrus Intellectual Property Law, LLP

(57) ABSTRACT

A method and apparatus for performing an order change in a corrugator uses a minimum slit head configuration with all slit heads carried on two sides of a single tool support structure. A single robot is operable on the support structure to independently reset the positions of slit heads during a running order to prepare for subsequent order change in a most efficient manner, utilizing order scheduling that eliminates order changes that cannot be formed with the minimum slit head configuration.

11 Claims, 8 Drawing Sheets

(56) References Cited

U.S. PATENT DOCUMENTS

| | | | | |
|---|---|---|---|---|
| 6,684,749 | B2 | 2/2004 | Adami | |
| 6,722,243 | B2 | 4/2004 | Adami | |
| 7,370,562 | B2 | 5/2008 | Adachi et al. | |
| 8,267,847 | B2 * | 9/2012 | Cummings et al. | 493/367 |
| 8,869,668 | B1 * | 10/2014 | Hotek et al. | 83/425.4 |
| 2001/0002560 | A1 | 6/2001 | Aoki | |
| 2004/0144223 | A1 * | 7/2004 | Koutonen et al. | 83/13 |
| 2011/0036220 | A1 * | 2/2011 | Paulson et al. | 83/13 |
| 2011/0293351 | A1 * | 12/2011 | Kwarta et al. | 400/621 |
| 2014/0240696 | A1 * | 8/2014 | Daul | 356/72 |

* cited by examiner

METHOD AND APPARATUS FOR A RULES BASED UTILIZATION OF A MINIMUM-SLIT-HEAD CONFIGURATION PLUNGE SLITTER

CROSS REFERENCE TO RELATED APPLICATIONS

This application is a divisional of U.S. patent application Ser. No. 12/579,868, filed on Oct. 15, 2009, which claims priority to U.S. Provisional Patent Application No. 61/105,456, filed Oct. 15, 2008, the contents of which is incorporated herein by reference in its entirety.

BACKGROUND OF THE INVENTION

The present invention pertains to a system for facilitating an order change in the dry end conversion of a corrugated paperboard web. In particular, the invention relates to a method and apparatus for accomplishing an order change using a minimum slit head configuration slitter.

In a corrugator dry end, where a corrugated paperboard web is longitudinally scored and slit into multiple parallel output webs (or "outs"), the outs are directed through one or more downstream cut-off knives which cut the output webs into selected sheet lengths. When two cut-off knives are used, they are vertically separated and each is capable of cutting the full corrugator width web. A web selector positioned downstream of the slitter/scorer, divides the outs into two groups, one of which is directed to the upper cut-off knife and the other to the lower cut-off knife. Order changes must be effected while the upstream corrugator wet end continues to produce and deliver the continuous web to the slitter/scorer. An order change will typically result in a change in widths of the output webs; requiring redirection of at least a central portion of the web from one knife level to the other and possibly changes in edge trim widths as well.

The prior art has developed two basic order change systems for corrugator dry ends utilizing double level cut-off knives. One system is known as a gapless or plunge style order change system. In this system, there are two slitter/scorer stations immediately adjacent one another in the direction of web movement and through both of which the web travels. At order change, one slitter/scorer, operating on the currently running order, will lift out of operative engagement with the web, and the other slitter/scorer which is set to the new order alignment plunges down into operative engagement with the web. The result is a small order change region of corrugated web with overlapping slits and scores for both the running and the new orders.

FIG. 1 and FIG. 2 show typical configuration of gapless order change slitter scorers. The FIG. 1 concept has a slit and score axis 110 (110*a*), 111 incorporated on each of two side frames 112, 113 with a trim slit waste collect chute 114, 115 for each station. FIG. 2 shows a single side frame 116 design with a score/score 117, 117/slit/slit 118, 118*a* configuration and single trim slit waste collect chute 120.

The second basic order change system is known as a gap style system. In this system, there is normally a single slitter/scorer station 121 as shown in FIG. 3. At order change, an upstream rotary shear severs the corrugated board web laterally. After the shear severs the web, the current running order is accelerated through the slitter to pull a gap between this tailing out order and the severed web emerging from the shear. As the tailing out web clears the slitter/scorer, the operative slit and score heads 122, 123 are quickly repositioned in the open gap. The leading edge of the new order then enters the slitter/scorer.

The two station gapless slitter of FIGS. 1 and 2 is preferred because it allows order changes at higher speeds and because there are inherent advantages associated with never severing the corrugated board web. Mainly, the potential for skew of either the tailing or leading edge webs is eliminated. Tailout accuracy is not affected by drastic tailout acceleration and potential for jam-up of the leading edge of the new order web is eliminated. A disadvantage of the two station plunge slitter concepts is that there is a duplication of slit and score heads that increases the cost and complexity of the slitter/scorer.

In principle, it would be possible to implement a gapless order change with a single slit axis machine 124, as shown in FIG. 4. This would involve plunging some of the heads 125 on the slit axis into the board line 126 to slit the outs associated with the running order while positioning the unused heads for the next order. Then at order change, the new order heads 125 would plunge into this board line while the old order heads 125 were removed from operative engagement with the web. In practice, this is not possible because of physical space occupied by the slit heads and the sometimes small difference between old and new order slit positions.

An approach to use of a single axis slitter to accomplish a gapless order change of FIG. 4 is described in U.S. Pat. No. 6,684,749. This concept uses pre-positioning of unused slit heads to the extent possible based on physical interference between running order slit heads and desired placement position of new order slit heads. Then, at order change, a robot 127 quickly repositions slit heads 125 as required in an order change zone between the new and old orders. While this approach solves the problem of physical interference between slit heads on the single axis slitter 124, it can create a quite long order change zone of scrap board depending upon the speed of the corrugator and the number of heads 125 that need to be moved.

OBJECTS OF THE INVENTION

An object of the invention is to achieve the continuous slitting and scoring of the corrugated web in a gapless order change with a slitter/scorer that has the fewest slit heads possible consistent with the specification for the maximum number of "outs" required.

A further objective of the invention is to minimize the length of waste material generated during the order change by accomplishing the change over from one job to the next as quickly as possible.

Another objective of a particularly advantageous embodiment of this invention is to provide a trim slit change-over method that will significantly improve order change-over reliability.

Yet another objective of the invention is to reduce the head support structure of the slitter scorer that will minimize the overall cost of the slitter/scorer.

It is also an objective of the invention to provide a slitting method that will require a small number of head positioning robots so as to reduce the overall cost and complexity of the slitter and to achieve a high reliability.

SUMMARY OF THE INVENTION

These and other objectives and advantages, which will be clear to those skilled in the art from reading the description that follows, are achieved with a slitter/scorer device that has slit heads mounted on both sides of a single support structure that allows heads from either side to be run in any combination. This allows some slit heads to be located and engaged in the web for a current running order while leaving space available for location of unused slit heads for an upcoming order.

DETAILED DESCRIPTION OF THE PREFERRED EMBODIMENTS

Prior art slitter/scorers have used two in-line series of rotary scoring tools and two in-line series of rotary slitting tools to make it possible to process one job on one series of slitting and scoring tools while the other series of slitting and scoring tools is positioned by robots for the processing of the next job. For a six-out slitter/scorer, there are a minimum of five internal slit heads required on one job. The prior art slitter/scorers utilize five internal slit heads on each slitter series.

Figure 4:
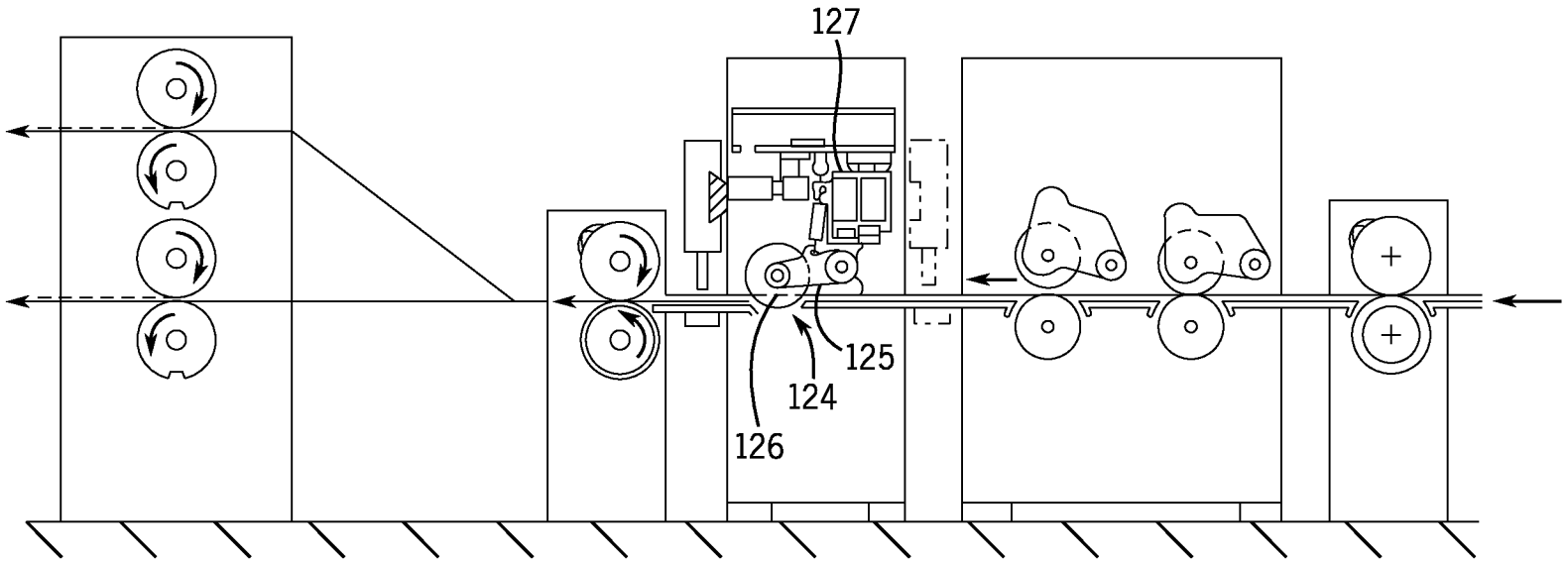
FIG. 4 PRIOR ART
FIG. 4 is a schematic side view of a prior art single-station, plunge-style, single-axis slitter/scorer.
Figure 5:
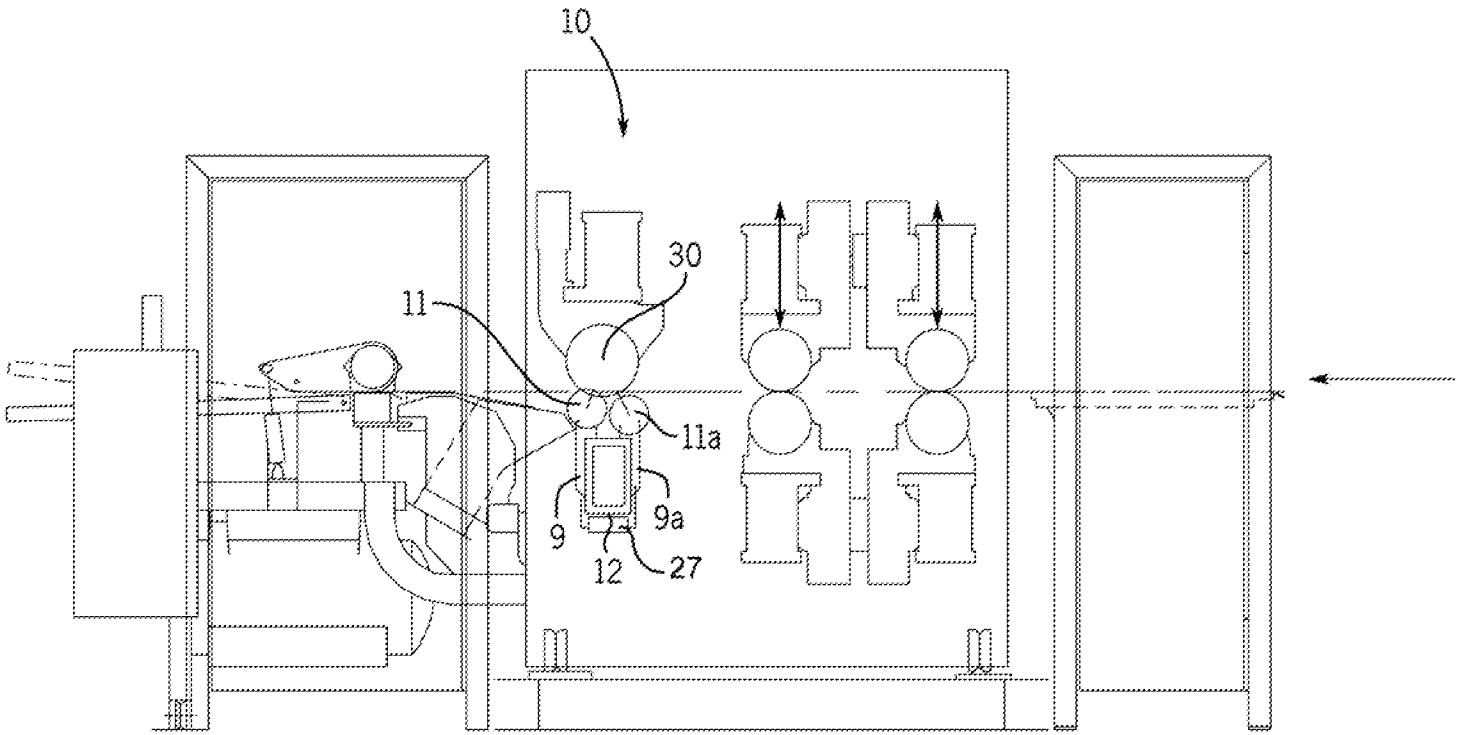
FIG. 5 is a schematic side view of a single-station, plunge-style, minimum-slit-head slitter/scorer of the present invention.
Figure 6:
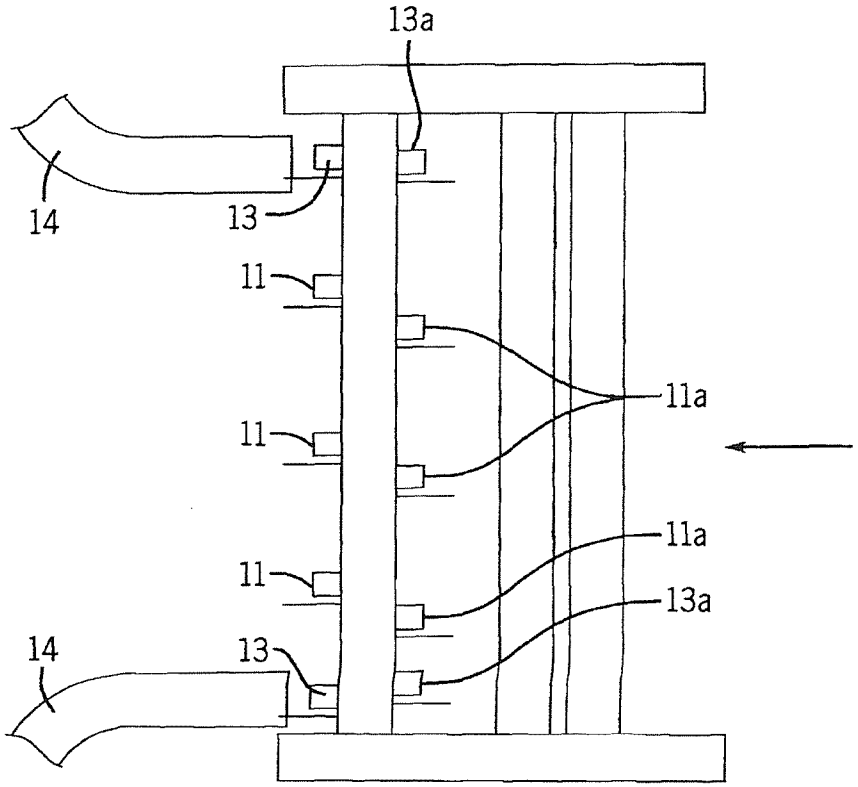
FIG. 6 is a schematic top view of a single-station, plunge-style, minimum-slit-head slitter/scorer of the present invention, showing dedicated trim slit heads.

FIG. 5 shows one embodiment of the single axis slitter/scorer 10 of the present invention. The slitter of the present invention, as also shown in FIG. 6, has three rotary plunge-style slit heads 11, 11*a* mounted on each side of a single tool support structure 12 for the preferred embodiment, or four fewer internal slit tools than the FIG. 4 prior art design. The single axis tool support structure 12 has a pair of slitting tool supports 9, 9*a* for holding slit heads 11, 11*a*, one support 9 being on the downstream side of the single axis support structure 12 and the other support 9*a* being on the upstream side. The slit heads or tools 11, 11*a* are operable to provide the slit lines defining the output webs or "outs" and will hereinafter be referred to as "internal" slitting heads or internal slitting tools to distinguish them from the edge trim slitting tools which will be described below. The present invention could be applied to the FIGS. 1 and 2 dual slit series prior art machines by also selecting heads from either series 110, 110*a* or 118, 118*a* to be run in any combination; however, the single slit head support structure 12 with single slit head positioning robot 27 of the preferred embodiment will provide a more simple, inexpensive and reliable design. Although the plunge-style slitting tools 11 shown in FIG. 5 may slit into anvil rollers positioned below the hoard line, it is preferred to use a single brush anvil roll 30.

Figure 1:
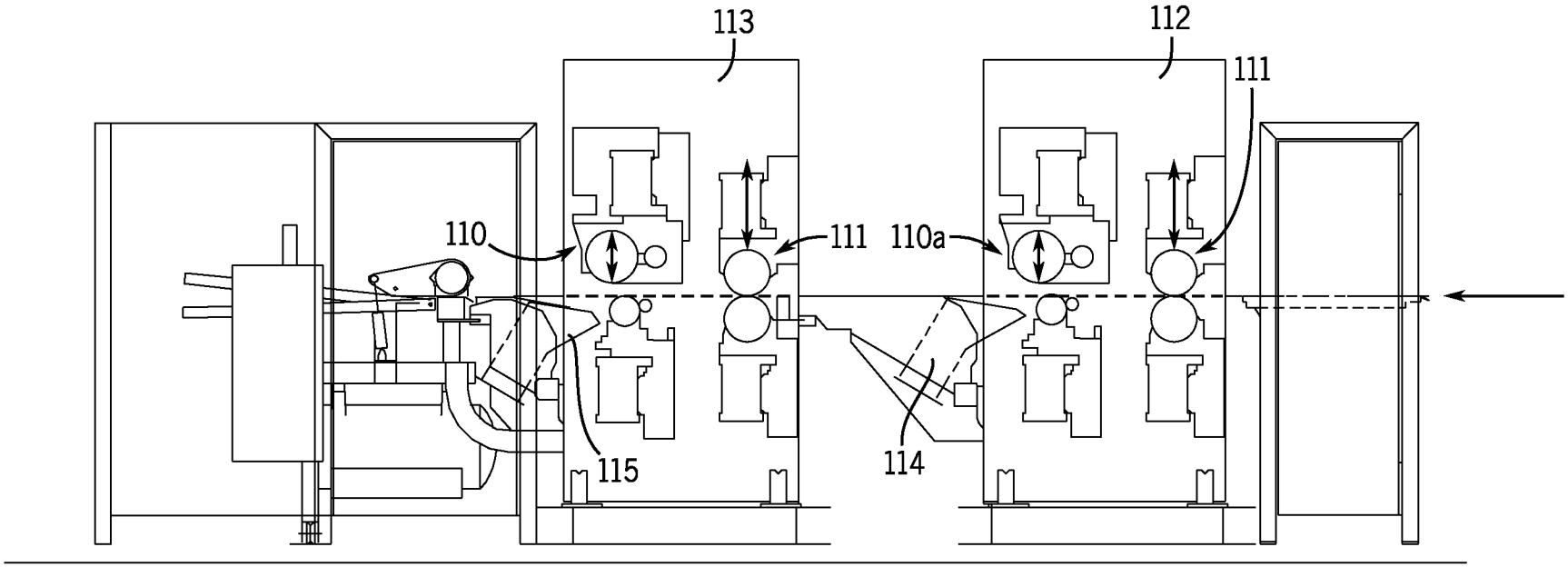
FIG. 1 PRIOR ART
FIG. 1 is a schematic side view of a prior art two-station plunge slitter/scorer.
Figure 2:
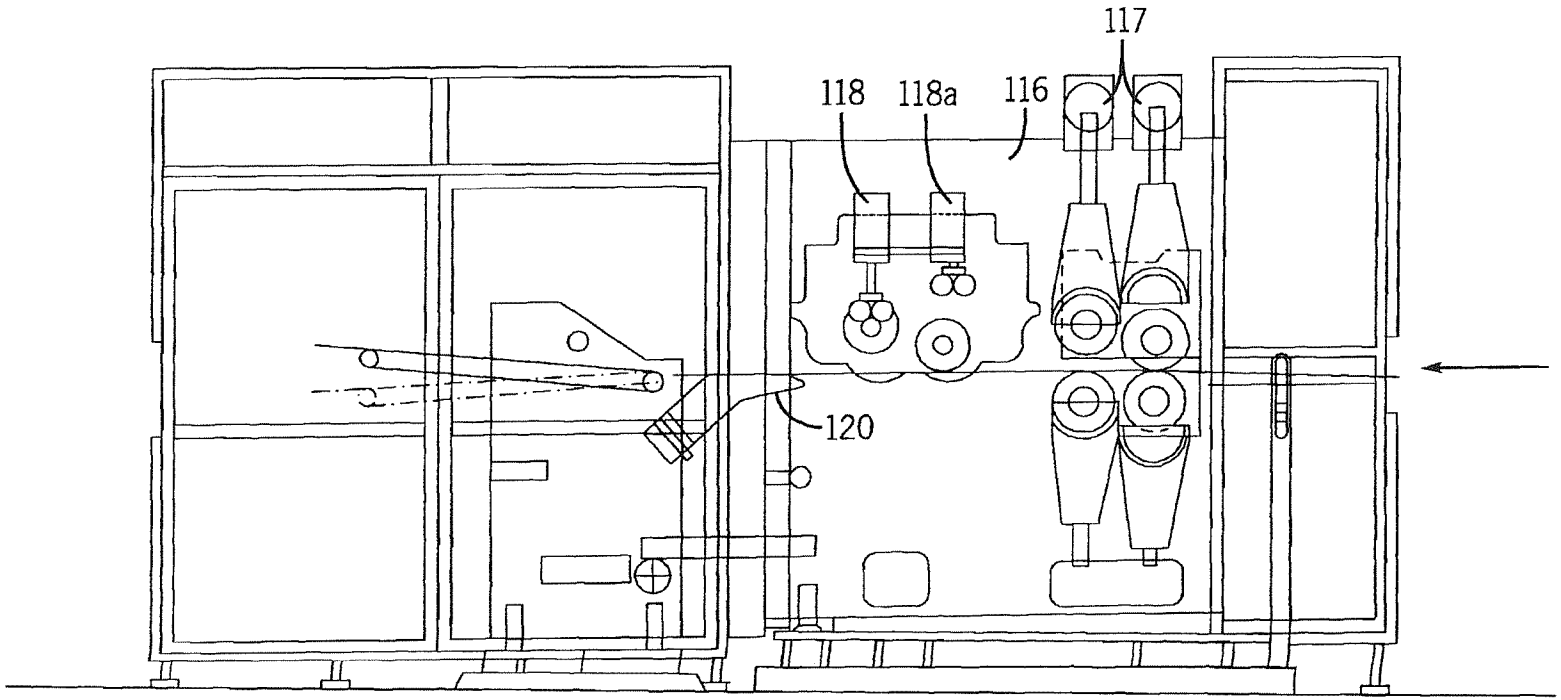
FIG. 2 PRIOR ART
FIG. 2 is a schematic side view of a prior art single-station, two-axis, plunge slitter/scorer.
Figure 3:
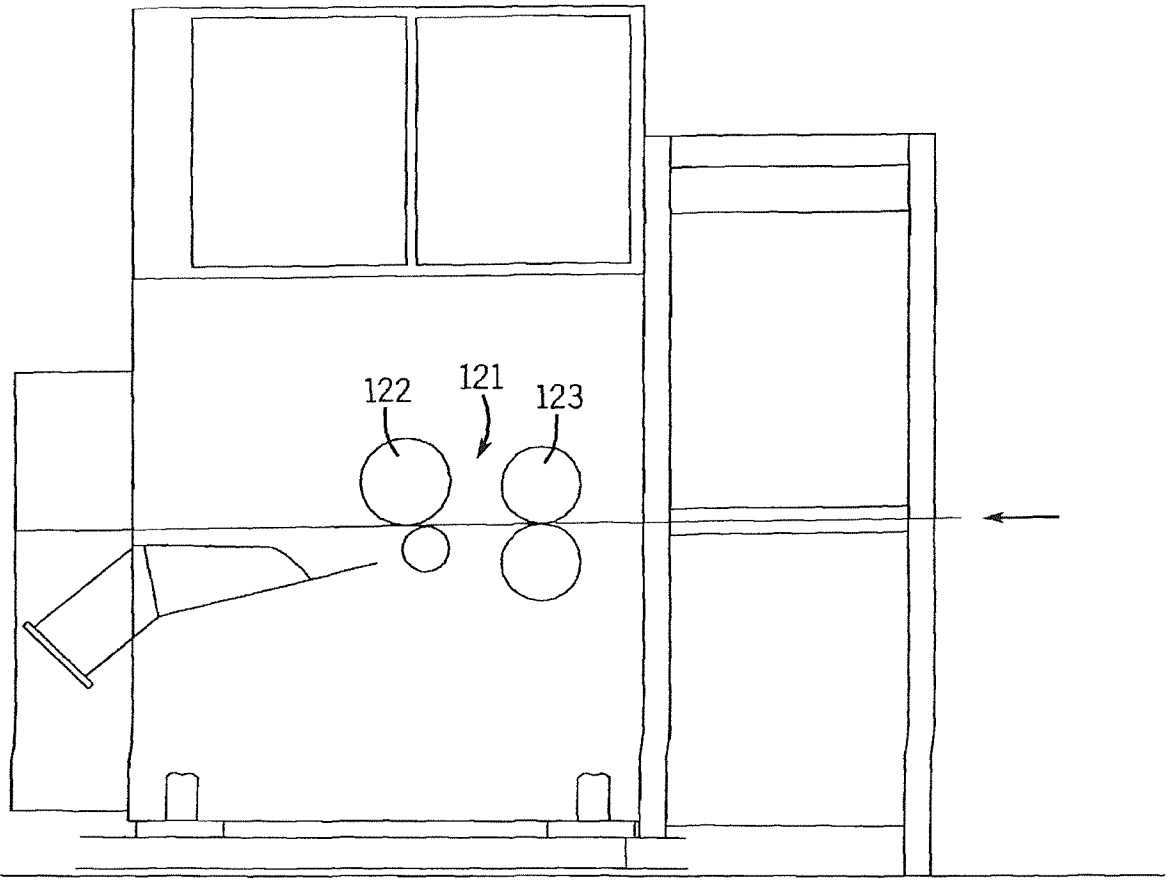
FIG. 3 PRIOR ART
FIG. 3 is a schematic side view of a prior art single-station, gap-style, quick setup, single-axis slitter/scorer.

The single axis slitter 10 of the present invention has dedicated trim slitting tools 13, 13*a* on each side and each end of the single slit axis, in addition to the internal slit heads 11, 11*a*. There will be a set of externally mounted trim chutes 14 as shown in FIG. 6. A problem associated with prior art two axes machines, as shown in FIG. 2, occurs at order change from the downstream slit axis 118 to the upstream slit axis 118*a*. In this situation, the trim created by the internal or upstream slit axis 118*a* must be shoved through the downstream slit axis 118 to reach the externally mounted trim chute 120. This has high potential for trim jam-up, particularly if the trim on the new order is very narrow. As a consequence, minimum trim widths are much wider than on slitters with multiple trim chutes 114, 115, such as shown in FIG. 1.

Figure 7:
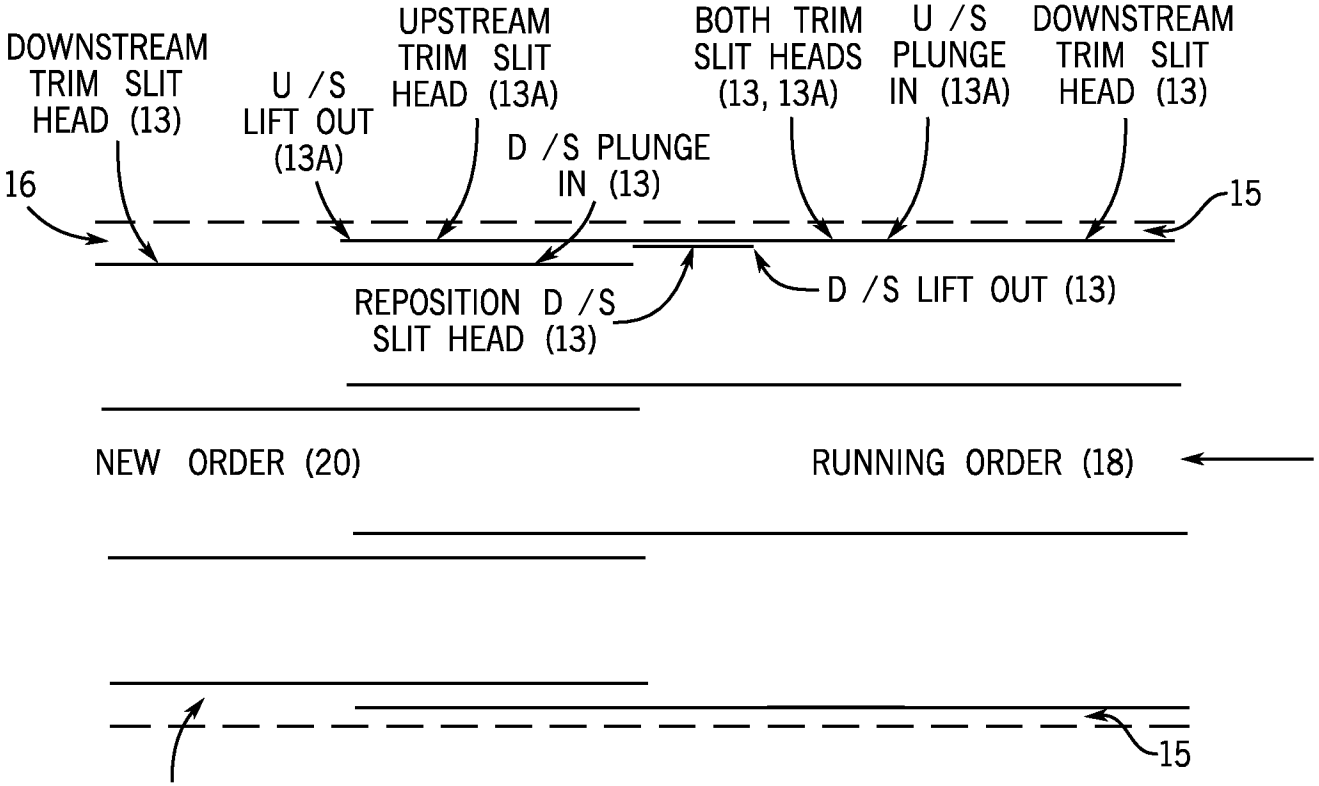
FIG. 7 is a schematic top view of a web with internal slit-out trim slits as required to complement the edge trim changeover of the present invention

This problem is solved by the present invention by a concept that always allows trim to be taken by the downstream dedicated trim slitting tool 13 of the FIG. 6 slitter/scorer 10. This is made possible by an aspect of the present invention whereby the dedicated trim slitting tool 13*a* on the upstream side of the single axis slitter plunges into the board line at the exact position of the current running dedicated trim slitting tool 13 on the downstream side of the slit axis with timing near the end of the old running order 18 as shown in FIG. 7. The timing is such that the dedicated trim slitting tool 13 on the downstream side of the slit axis then lifts up out of operative engagement with the running order trim 15 and is repositioned by the robot 27 at the position required for the trim 16 of the new order 20. At order change, the dedicated trim slit tool 13*a* on the upstream side of the slit axis then lifts out of the boardline after the end of the current running order and the dedicated trim slit tool 13 on the downstream side of the single slit axis engages with the new order to create the new order trim 16. This eliminates the requirement to "shove" the trim from the upstream dedicated trim tool at an order change.

Figure 8:
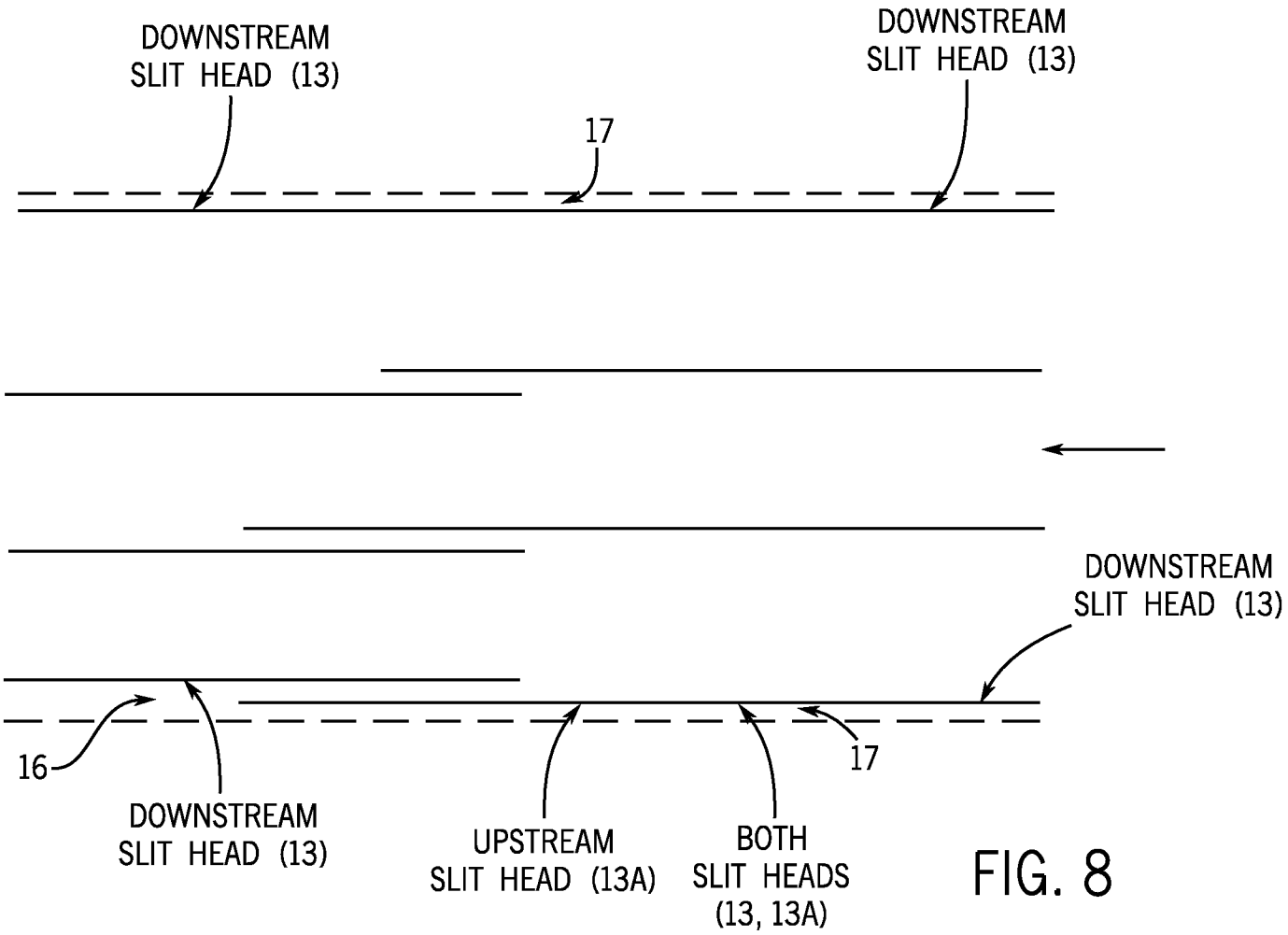
FIG. 8 is a schematic top view of a web with internal slit-out trim slits as required for an asymmetric trim order change.

Another aspect of the current invention involves the use of asymmetric trim to allow use of an otherwise dedicated upstream mounted trim slit tool 13*a* for internal web slitting. This occurs when going into or out of a five- or six-out order to maximize the number of slit heads available for the changeover. This method of order change involves leaving the dedicated trim slit tool 13 engaged in its currently running position at order changeover, as shown in FIG. 8. Since total out widths are different for each dry end setup made with a given running wet end corrugated web width, it is customary to take symmetric trim on each side of the slitter. But, if the five-or six-out is correctly positioned in the order queue, it is possible to do the order change by taking asymmetric trim 17 with one trim slit tool 13 not moved at order change. This, then, allows the dedicated trim slit tool 13*a* on the upstream side of the machine to be used for an internal board slit. This facilitates a plunge type order change for a greater number of outs with a minimal slitter/scorer slit tool configuration.

Another aspect of the present invention is the use of asymmetric trim and graceful degradation of the order change process from a gapless change to a gap-style change when making an order change from or to a five- or six-out. This allows the pre-set of unused slitting tools to be available during the running of the old order and then a positioning of the robot 27 on one currently running tool 11, 11*a*, or 13*a* closely located in a cross corrugator position to the required position for the new order. At order change, a gap is pulled and the robot 27 quickly positions the slit head 11, 11*a*, or 13*a* in the gap as the tailing out order clears the slitter. Alternately, the order change region as described in US Patent Application Publication No. US 2006/0090617 and shown in FIG. 5 thereof, could be extended in length to give the robot time as required to reposition the additional slitting tool. This aspect of the invention along with the asymmetric trim allows order change from or to a six-out from or to a four-out or less using a gap-style order change with a minimal complement of six total internal slit heads 11, 11*a*.

Another aspect of the current invention is the use of a rules-based order scheduling module to accommodate the specific limitations of the single axis plunge slitter that has a complement of six internal slit heads. In the normal scheduling of a corrugator, the scheduling software assumes that capability exists for solutions involving numbers of outs of successive orders in any combination up to the maximum possible. The solutions also assume the use of symmetric trim by the slitter setup controls and so only provides web width and out widths to derive a trim combination solution. The goal of this scheduling software is to pick order solutions that minimize the overall average trim widths in a wet end paper setup. There is a problem with this type of scheduling system when used on a corrugator with a slitter/scorer of the configuration of the present invention. The problem is that, in the absence of any rules to the contrary, the schedule solutions may well involve orders with number of outs on successive orders that exceed the capability of the slitter scorer. An objective of the slitter/scorer of the present invention is to reduce the overall cost of the machine by reducing the slit head complement. This reduced slit head machine cannot perform order changes on six-out to six-out or five-out back-to-back orders. The solution to this problem is to include a software module that will take the dry end setup solutions provided by the scheduling system and to reconfigure the sequence in which these orders are scheduled for the express purpose of eliminating six-out to six-out or five-out back-to-back orders. A second aspect of the solution is the selection of orders to precede or follow six-out or five-out orders with either two-out or three-out orders; or with three-out or four-out orders with trim width solutions that are wide enough to run asymmetric trim on the five-or six-out running order as well as the order following the five-out or six-out order. Failing any of the foregoing solutions, the software module will signal that a gap-style or extended order change zone gapless order is to be run, will select a running order head to be positioned by the robot in the gap or order change zone and schedule an asymmetric trim solution. The function, then, of the software module is to custom tailor the scheduling solutions to the specific capability of the slitter of the present invention. Since six-outs and five-outs are normally not common in the industry, this software module will succeed in all but the most unusual situation. Of course, if no successful solution in terms of dry end order sequence can be found using the rules-based software modules, then feedback is provided to the scheduling system indicating that different paper combinations will be required to run the orders.

It would be consistent with the present invention to add more internal slit heads to the slitter/scorer if a specific plant felt that there were good reasons why larger number of six-out and five-out orders would be scheduled. By adding two internal slit heads to each side of the single slit axis, it would be possible to schedule without constraint, six-out and five-out orders back-to-back, without asymmetric trim in the plunge order change mode of operation. The machine would then take on the characteristic of current technology two-axis solutions as epitomized by the FIG. 2 slitter/scorer. Short of the addition of these extra heads, the slitter would be used on a single-axis mode consistent with the present invention. It is also consistent with this invention to add an additional internal slit head to each side of the single tool support structure 10 to provide for up to eight-out slitting.

In FIG. 5, a rotary brush anvil 30 is used to support the web into which the rotary slitting tools 11, 11*a* plunge upwardly for slitting. The rotary brush anvil eliminates the need to utilize individually positionable anvil rollers. The brush anvil roller 30 preferably extends the full width of the web and, therefore, also provides the anvil for the dedicated trim slitting tools 13, 13*a*.

What is claimed is:

1. In a slitting apparatus for a continuous corrugated paperboard web, the apparatus operable to provide longitudinal slit lines in the web passing through the apparatus, the slit lines dividing the web into a plurality of output webs of selected widths not exceeding a selected maximum number, the apparatus including internal web slitting tools operable by a robotic positioner to establish the slit lines of the output webs of a running order and to reposition the internal slitting tools for the slit lines of the output webs of a following new order, the internal slitting tools being further operable to plunge into the web at the start of the running order and to be retracted from the web at the end of the running order and repositioned for the new order, the improvement comprising:

a slitting tool support structure defining a single transverse axis for carrying the internal slitting tools to selected positions transversely of a direction of travel of the web;

a series of internal slitting tools comprising a minimum number equal to the selected maximum number of output webs and mounted to be distributed along the single axis in a transversely-defined downstream group on a downstream side of the single axis and in a transversely-defined upstream group on an upstream side of the single axis, the downstream and upstream sides being defined with respect to the direction of web travel, whereby any of the internal slitting tools of either the downstream or the upstream group can be selectively positioned without interfering contact with the internal slitting tools of the other of the upstream or the downstream group; and a single robotic positioner operable along the single transverse axis to position the internal slitting tools in both the downstream group and the upstream group.

2. The apparatus as set forth in claim 1, wherein the internal slitting tools have rotary blades, and further including a brush anvil supporting the web above the single axis and positioned to receive the rotary blades as they plunge into the web.

3. The apparatus as set forth in claim 2, further comprising:

a first pair of trim slitting tools, one mounted on the downstream side and one mounted on the upstream side of the single axis for slitting web edge trim of selected widths at a first lateral edge of the web: and a second pair of trim slitting tools, one mounted on the downstream side and one mounted on the upstream side of the single axis for slitting web edge trim of selected widths at a second lateral edge of the web;

each of the first and second pairs of downstream and upstream trim slitting tools at both the first and second lateral edges of the web operable by the robotic positioner to establish a trim slit line in a manner that permits the downstream trim slitting tool to make a trim slit line on the running order, to simultaneously position the upstream trim slitting, tool to plunge into the running order trim slit line near the end of the running order, to retract the downstream trim slitting tool from the running order trim slit line, to reposition the downstream trim slitting tool for a new order trim slit line, to plunge the downstream trim slitting tool into the new order trim slit line at the beginning of the new order, and to retract the upstream trim slitting tool after the end of the running order.

4. The apparatus as set forth in claim 3, wherein the brush anvil comprises a rotary brush and is adapted to receive the rotary blades of the internal slitting tools and rotary blades of the trim slitting tools.

5. In a slitting apparatus for a continuous corrugated paperboard web, the apparatus operable to provide longitudinal slit lines in the web passing through the apparatus, the slit lines dividing the web into a plurality of output webs of selected widths not exceeding a selected maximum number, the apparatus including internal web slitting tools operable by a robotic positioner to establish the slit lines of the output webs of a running order and to reposition the internal slitting tools for the slit lines of the output webs of a following new order, the internal slitting tools being further operable to plunge into the web at the start of the running order and to be retracted from the web at the end of the running order and repositioned for the new order, the improvement comprising:

a slitting tool support structure extending transversely with respect to a direction of web travel along a single transverse axis, and carrying the internal slitting tools to selected positions transversely of the direction of web travel;

a transversely-defined downstream group of internal slitting tools on a downstream side of the single transverse axis;

a transversely-defined upstream group of internal slitting tools on an upstream side of the single transverse axis;

wherein the downstream and upstream sides of the single transverse axis are defined with respect to the direction of web travel;

wherein the downstream and upstream groups of internal slitting tools are coupled to the slitting tool support structure on either side of the single transverse axis; and wherein any of the internal slitting took of either the downstream or the upstream group can be selectively positioned without interfering contact with the internal slitting tools of the other of the upstream or the downstream group; and a single robotic positioner operable along the single transverse axis to position the internal slitting tools in both the downstream group and the upstream group.

6. The apparatus as set forth in claim 5, further comprising:

a first pair of trim slitting, tools, mounted such that one is on the downstream side and one is on the upstream side of the single axis, for slitting web edge trim of selected widths at a first lateral edge of the web; and a second pair of trim slitting tools, mounted such that one is on the downstream side and one is on the upstream side of the single axis, for slitting web edge trim of selected widths at a second lateral edge of the web;

wherein the first and second pairs of trim slitting tools are positioned one on either side of the downstream and upstream groups of internal slitting tools.

7. The apparatus as set forth in claim 6, wherein each of the first and second pairs of downstream and upstream trim slitting tools at both the first and second lateral edges of the web are operable by the robotic positioner to establish a trim slit line in a manner that permits the downstream trim slitting tool to make a trim slit line on the running order, to simultaneously position the upstream trim slitting tool to plunge into the running order trim slit line near the end of the running order, and to retract the downstream trim slitting tool from the running order trim slit line.

8. The apparatus as set forth in claim 7, wherein each of the first and second pairs of downstream and upstream trim slitting tools at both the first and second lateral edges of the web are operable by the robotic positioner to thereafter reposition the downstream trim slitting tool for a new order trim slit line, to plunge the downstream trim slitting tool into the new order trim slit line at the beginning of the new order, and to retract the upstream trim slitting tool after the end of the running order.

9. The apparatus as set forth in claim 6, wherein the internal slitting tools have rotary blades and the trim slitting tools have rotary blades.

10. The apparatus as set forth in claim 9, further comprising. a brush anvil supporting the web above the single axis and positioned to receive the rotary blades of the internal slitting tools and the rotatory blades of the trim slitting tools as they plunge into the web.

11. The apparatus as set forth in claim 10, wherein the brush anvil comprises a rotary brush anvil.

* * * * *

UNITED STATES PATENT AND TRADEMARK OFFICE

CERTIFICATE OF CORRECTION

PATENT NO. : 9,199,387 B2
APPLICATION NO. : 13/585593
DATED : December 1, 2015
INVENTOR(S) : James A. Cummings, John J. Kondratuk and Ronald H. Schmidt It is certified that error appears in the above-identified patent and that said Letters Patent is hereby corrected as shown below:

In the claims

In claim 3, at column 6, line 59: the "," should be removed after the word 'slitting'.

In claim 5, at column 7, line 35: the word 'took' should instead read --tools--.

In claim 6, at column 8, line 2: the "," should be removed after the word 'slitting'.

In claim 10, at column 8, line 36: the "." should be removed after the word 'comprising'.

Signed and Sealed this
Nineteenth Day of April, 2016

Michelle K. Lee

Michelle K. Lee
*Director of the United States Patent and Trademark Office*